US006488474B2

(12) United States Patent
Chuang

(10) Patent No.: US 6,488,474 B2
(45) Date of Patent: Dec. 3, 2002

(54) HEAT DISSIPATING FAN

(76) Inventor: Wen-Hao Chuang, No. 150, Lane 250, Kung-Yeh 2nd Rd., Lin-Yuan Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/755,077

(22) Filed: Jan. 8, 2001

(65) Prior Publication Data

US 2002/0090299 A1 Jul. 11, 2002

(51) Int. Cl.[7] ..... B64C 11/14
(52) U.S. Cl. ..... 416/244 R
(58) Field of Search ..... 416/244 R, 204 R, 416/179, 182, 185; 403/326, 327, 329

(56) References Cited

U.S. PATENT DOCUMENTS 3,937,595 A * 2/1976 English et al. ..... 416/244 R

FOREIGN PATENT DOCUMENTS

GB 2041102 A * 9/1980 ..... F04D/29/32

* cited by examiner

*Primary Examiner*—Edward K. Look
*Assistant Examiner*—Dwayne J. White
(74) *Attorney, Agent, or Firm*—Birch, Stewart, Kolasch & Birch, LLP

(57) ABSTRACT

A heat dissipating fan includes an impeller which has a hub extended forward from a rear wall. The hub has a plurality of first tenons formed at the front rim and a plurality of spaced slots. The spaced slots form a plurality of radial lugs such that the hub becomes elastic. The rotor of the fan is placed in the hub quickly and securely to complete the fan assembly. The impeller further has an annular sleeve which has a plurality of second tenons. Each second tenon is bordered by a pair of second slots at two sides. The motor shell may engage with the inner circumference of the sleeve and is held securely by the second tenons.

3 Claims, 5 Drawing Sheets

HEAT DISSIPATING FAN

BACKGROUND OF THE INVENTION

This invention relates to a heat dissipating fan and particularly an improved heat dissipating fan that has a novel impeller which enables rapid assembly of the fan.

Conventional heat dissipating fans for computer processors known in the art mostly have a preformed rotor (or an inner circumference engaged with a motor shell) in the center. Because of technical constraints in injection molding process, the fans thus made have the following disadvantages:

1. The rotor (or motor shell) of the fan has to be disposed ahead in the mold of the fan impeller during the injection forming process to be integrally formed together. This is tedious and time-consuming work.
2. Disposing the rotor (or motor shell) in the mold before injection forming of the fan impeller is a precise operation. Any negligence by the operators may result in impeller damage or even cause a safety hazard for the operators.

The foregoing problems are mainly caused by the structural design deficiency of the fan. There is still room for improvement.

SUMMARY OF THE INVENTION

It is therefore an object of this invention to provide an improved heat dissipating fan that has a novel impeller structure which enables fabrication and assembly of the fan in a simpler, safer and more efficient manner.

In one aspect, the fan according to this invention has a plurality of first tenons and first slots and lugs formed in the hub of the fan impeller for engaging with the rotor of the motor rapidly and securely. The fan impeller further has a sleeve which has a plurality of second tenons and second slots for rapidly and securely engaging with the motor shell. Because of such construction, the rotor or motor shell may be assembled with the fan impeller separately after the impeller has been made by the injection molding process. Fabrication and assembly of the fan thus is much simpler, safer and more efficient.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention, as well as its many advantages, may be further un stood by the following detailed description and drawings, which are given by way of illustration only, and thus are not limitative of the present invention, and in which.

DESCRIPTION OF THE PREFERRED EMBODIMENTS

Figure 2:
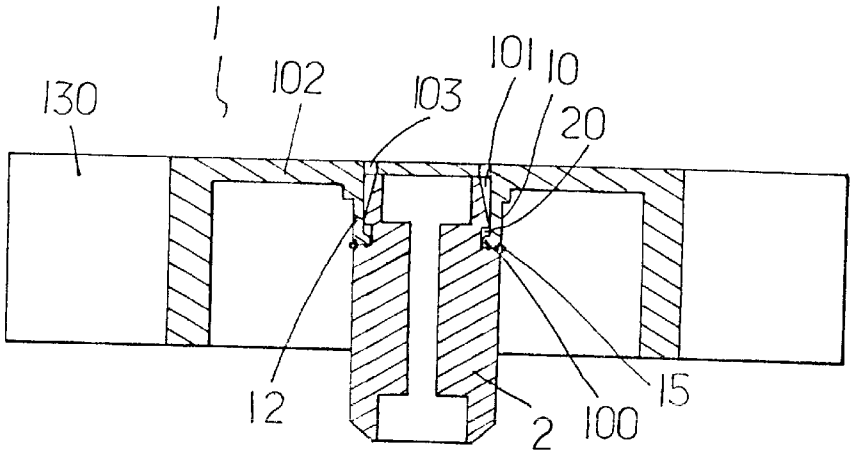
FIG. 2 is a sectional view of this invention, according to FIG. 1
Figure 3:
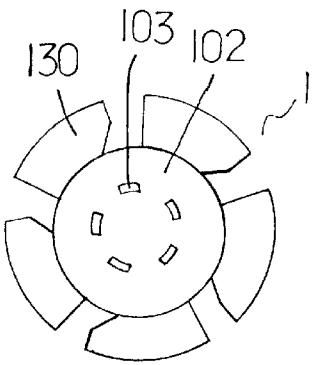
FIG. 3 is a rear view of an impeller of this invention, according to FIG. 1.
Figure 1:
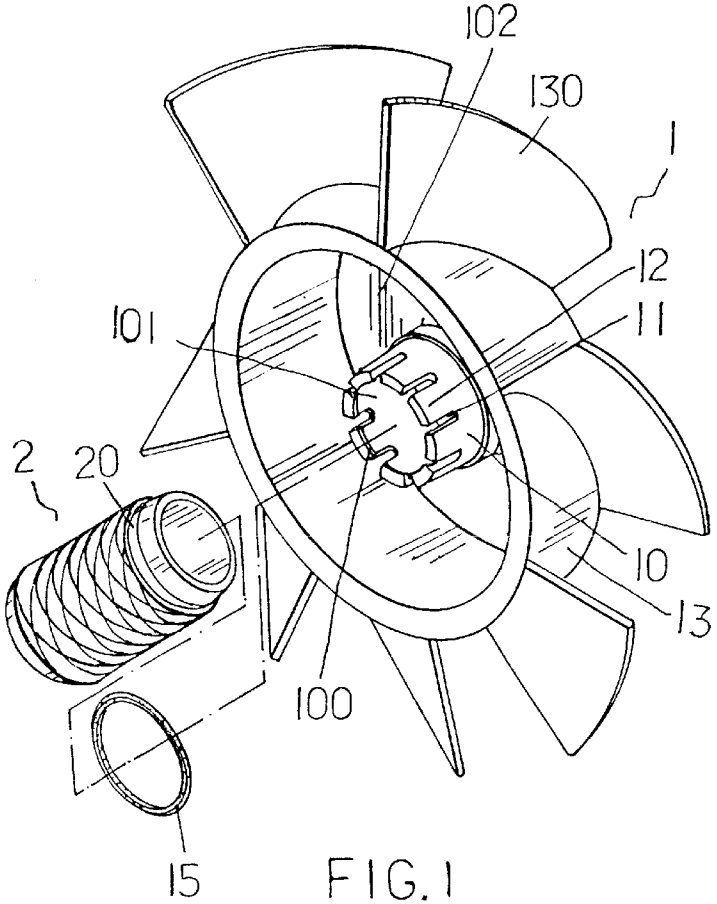
FIG. 1 is an exploded view of this invention.

Referring to FIGS. 1 and 2, the fan according to this invention has an impeller 1 which has a rear wall 102 in which there are a plurality of mold releasing first through holes 103 formed around the circumference of a spindle opening 101 (also shown in FIG. 3). From the front side of the rear wall 102 around the spindle opening 101, a circular hub 10 extends forward. On the inner side of the circumference of the front rim of the hub 10, there are a plurality of first tenons 100 corresponding to the first through hole 103. At the front section of the hub 10 between every two adjacent first tenons 100 not corresponding to the first through holes 103, a first slot 11 is formed. Between a pair of the adjacent first slots 11, a lug 12 is formed on the hub 10. The lugs 12 are formed radially about the axial line of the impeller 1. The first tenons 100 have elastic gripping force.

Figure 4:
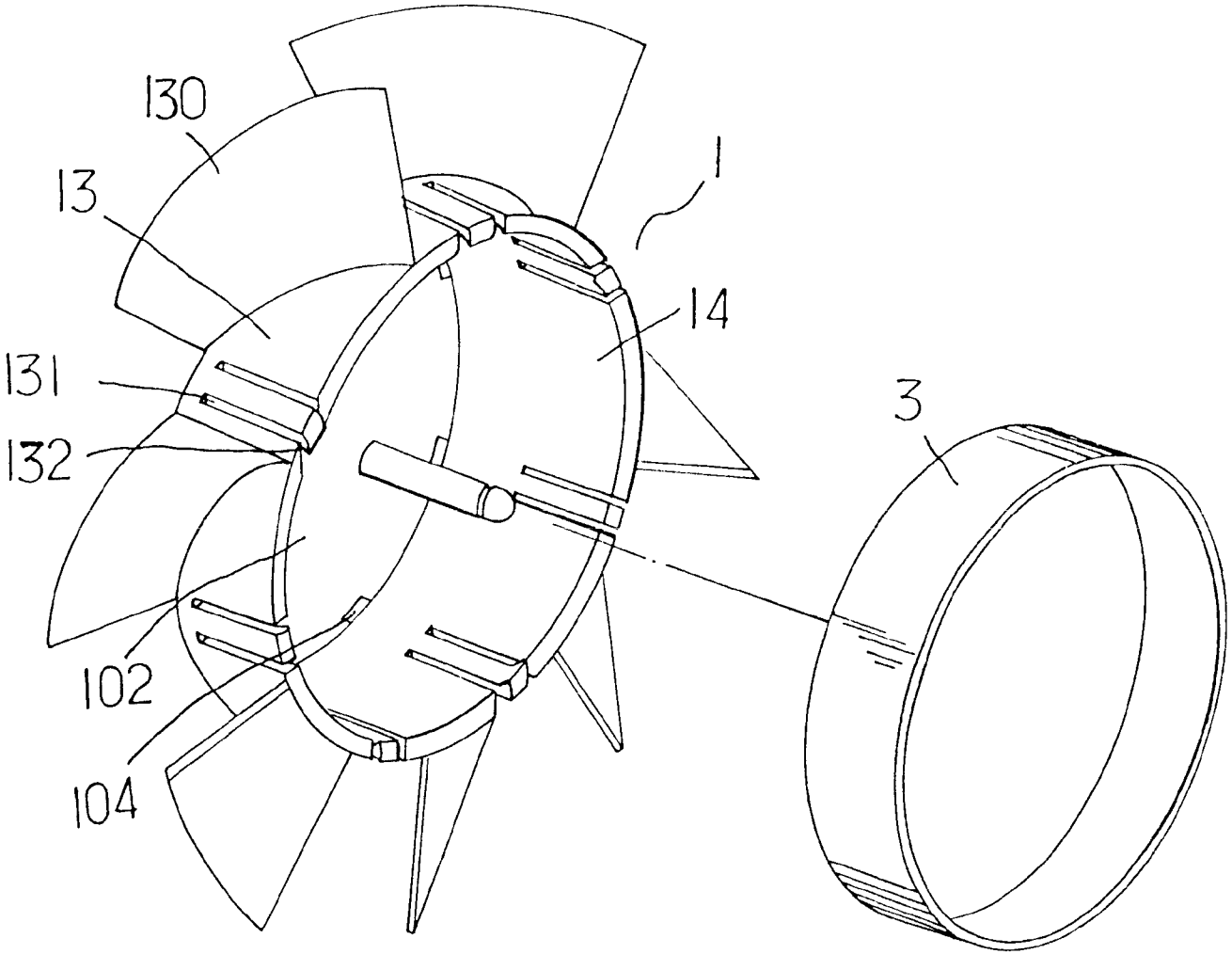
FIG. 4 is an exploded view of an impeller and motor shell.
Figure 5:
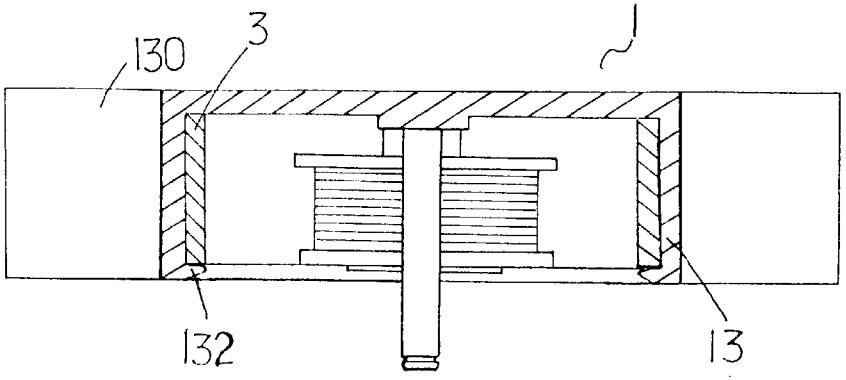
FIG. 5 is a sectional view of the assembled impeller and motor shell according to FIG. 4.
Figure 6:
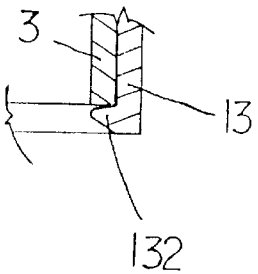
FIG.6 is fragmentary sectional view of the impeller and motor shell, according to FIG. 5.

Referring to FIGS. 4, 5, and 6, in the rear wall 102 of the impeller 1 at the outer circumference, there are a plurality of mold releasing second through holes 104. The impeller 1 further has a sleeve 13 which has a plurality of second tenons 132 formed on the inside wall of the sleeve 13 corresponding to the one second through hole 104. Each second tenon 132 is bordered by second slots 131 at two sides thereof. When a motor shell 3 is slid into the impeller 1 within the inside circumference 14 of the impeller 1, the outer rim of the motor shell will be securely held by the second tenons 132.

The fan further has rotor 2 which is a hollow barrel and has an annular groove ring 20 formed at a rear end. When the rotor 2 is disposed in the hub 10 through the rear end, the groove ring 20 will engage with the first tenons 100 for the rotor 2 to be securely held in the hub 10. A girdle ring 15 may be provided to surround the circumference of the first tenons 100 and groove ring 20 to further enhance the fastening of the hub 10 over the rotor 2 so that the rotor 2 will not be loosened during fan rotation.

With the aid of the second slots 131, the motor shell 3 may be slid easily into the inside circumference 14 of the impeller 1 even with a small dimension tolerance to complete the assembly of the rotor 2 and the impeller 1.

Figure 7:
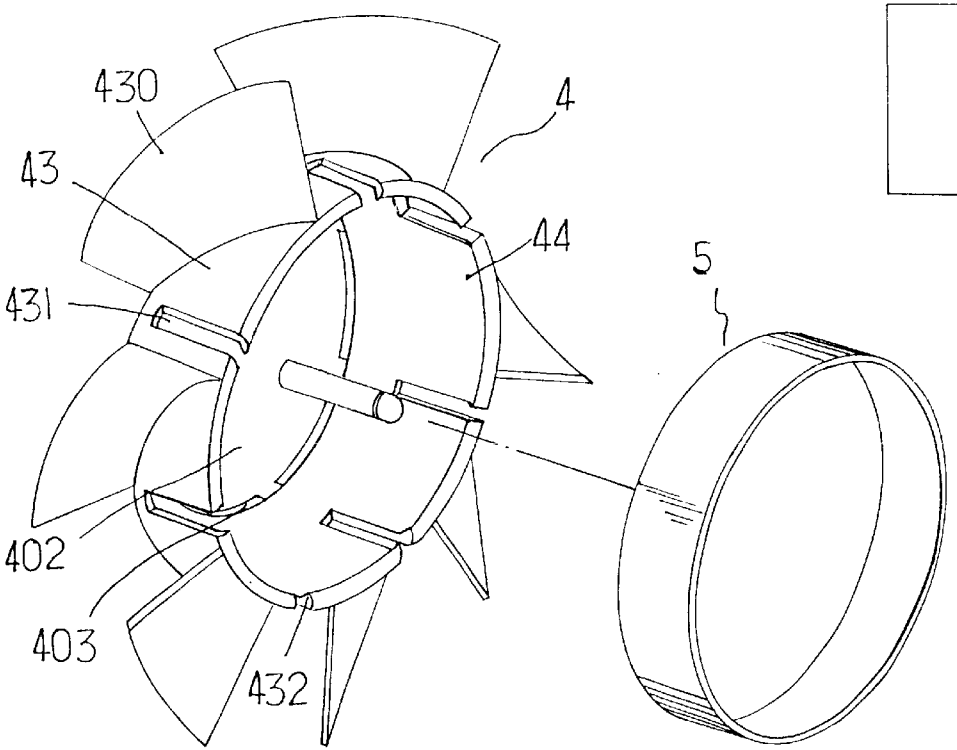
FIG. 7 is an exploded view of another embodiment of this invention.
Figure 8:
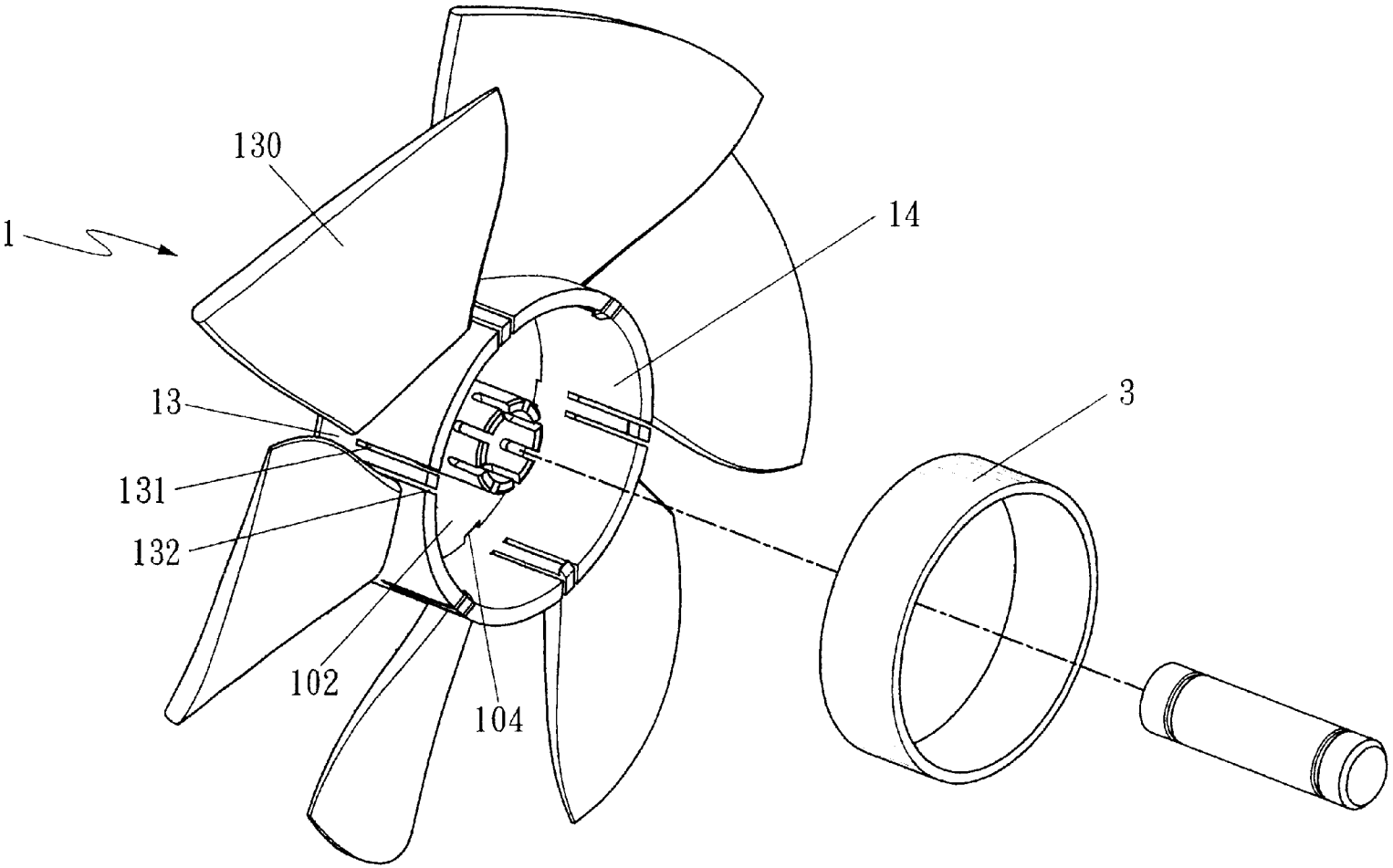
Figure 9:
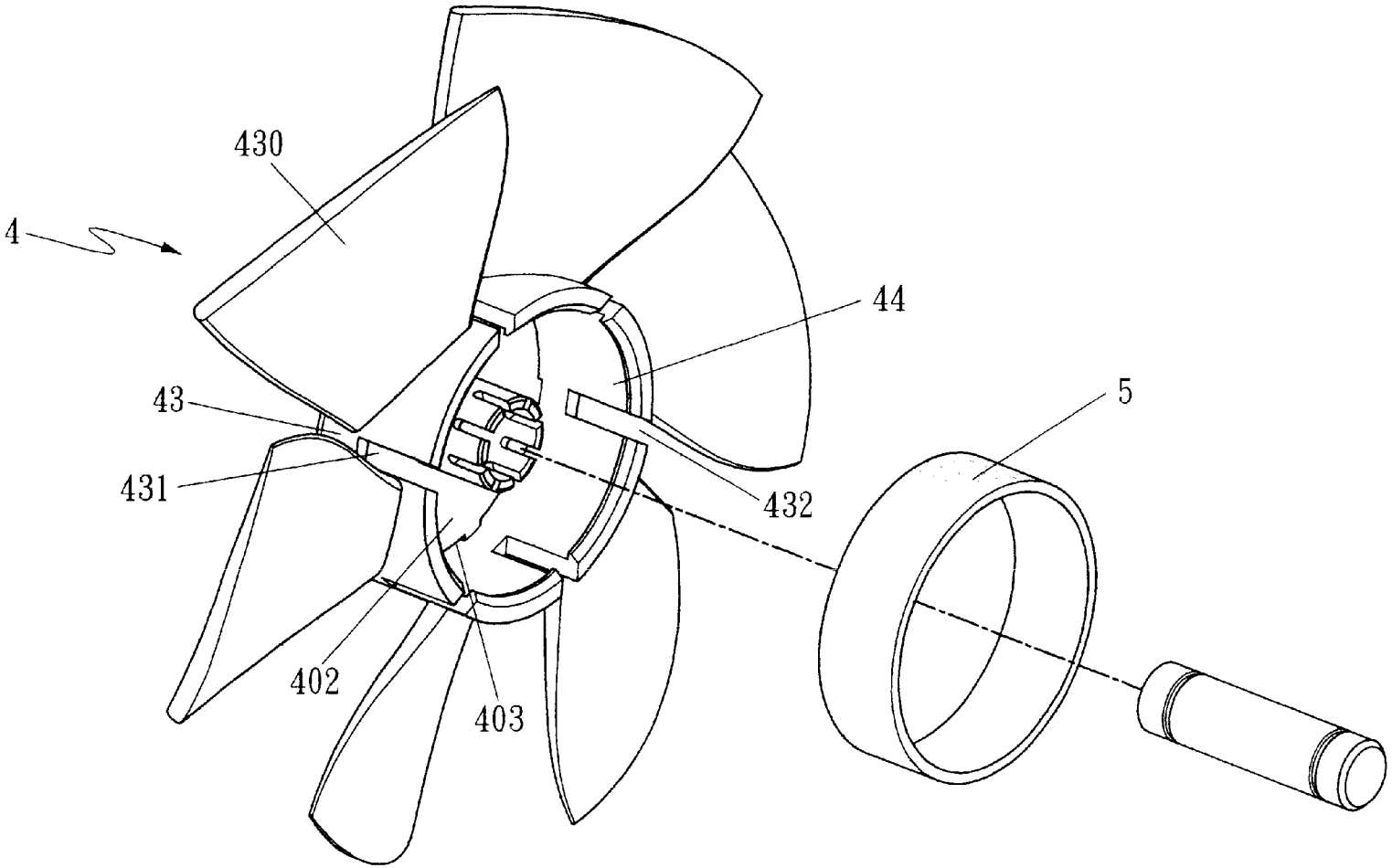

FIG. 7 shows another embodiment of this invention. The rear wall 402 of the impeller 4 has a plurality of third through holes 403 formed around a sleeve 43. The sleeve 43 has a plurality of third tenons 432 formed at the front rim thereof corresponding to the third through hole 403. Each third tenon 432 is bordered by third slots 431 at two sides. The third slots 431 are formed in the sleeve 43 at selected locations between the blades 430 of the fan. The motor shell 5 thus may be slid into the impeller 4 within the inner circumference 44 of the sleeve 43 and be held securely by the third tenons 432.

By means of the construction set forth above, this invention has the following advantages:

1. The rotor or motor shell does not need to be disposed into the mold before injection forming the impeller of the fan. Instead, the rotor or motor shell may be assembled with the impeller after the impeller has been made. Fabrication process of the impeller and fan is much simpler and faster.
2. The impeller made through this invention may be adapted to various types of rotor or motor shell. Assembly is convenient and faster. The impeller has greater tolerance for the rotor and motor shell, and may avoid the rotor or motor shell rework or redesign that might otherwise happen.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heat dissipating fan, comprising:

an impeller having a plurality of mold releasing first through holes formed in a rear wall thereof and a hub extended forward from the rear wall around an axial line of an impeller spindle, the hub having a plurality of first tenons formed at a front rim thereof with each tenon corresponding to one of the first through holes, a first slot formed in the hub from the front rim thereof between a pair of the first tenons, and a plurality of lugs each being formed on the hub radially between a pair of the first slots; and a rotor housed in the hub having an annular groove ring engaged with the first tenons and an annular girdle ring surrounding the hub over the groove ring for holding the rotor in the hub securely during rotation of the impeller.

2. The heat dissipating fan of claim 1, wherein the impeller has an annular sleeve and a plurality of second through holes formed in the rear wall around the sleeve, the sleeve having a plurality of second tenons formed at a front rim thereof with each tenon corresponding to one of the second through holes, a pair of spaced second slots formed at two sides of the second tenon, and an inner circumference for housing a motor shell therein securely.

3. The heat dissipating fan of claim 1, wherein the impeller has an annular sleeve and a plurality of third through holes formed in the rear wall around the sleeve, the sleeve having a plurality of-third tenons formed at a front rim thereof with each tenon corresponding to one of the third through holes, a plurality of third slots each formed in the sleeve at a selected location between a pair of fan blades not corresponding to the third through holes, and an inner circumference for housing a motor shell therein securely.

* * * * *